United States Patent [19]

Becka et al.

[11] Patent Number: 4,879,778

[45] Date of Patent: Nov. 14, 1989

[54] HEEL MOLDER

[75] Inventors: Michael M. Becka, Nashua; William Walega, Hollis, both of N.H.

[73] Assignee: International Shoe Machine Corporation, Nashua, N.H.

[21] Appl. No.: 278,983

[22] Filed: Dec. 2, 1988

Related U.S. Application Data

[63] Continuation-in-part of Ser. No. 186,417, Apr. 26, 1988, abandoned.

[51] Int. Cl.[4] ..... A43D 11/00

[52] U.S. Cl. ..... 12/146 D; 12/54.3; 12/12.5

[58] Field of Search ..... 12/54.3, 10.5, 12.5, 12/53.1, 54.4, 146 D

[56] References Cited

U.S. PATENT DOCUMENTS

| | | | |
|---|---|---|---|
| 3,328,815 | 7/1967 | Forma | 12/54.3 |
| 4,485,512 | 12/1984 | Flanders et al. | 12/54.3 |
| 4,553,281 | 11/1985 | Vornberger | 12/8.1 |
| 4,660,242 | 4/1987 | Vornberger et al. | 12/54.3 |
| 4,679,269 | 7/1987 | Becka et al. | 12/10.5 |
| 4,709,433 | 12/1987 | Walega | 12/12.5 |

*Primary Examiner*—Steven N. Meyers
*Attorney, Agent, or Firm*—Robert Shaw

[57] ABSTRACT

A heel molder to form the heel part of a footwear upper assembly. The heel part includes a thermally-activated material that is deformable when heated above a threshold temperature; it is non-deformable below that threshold temperature; it is non-deformable at room temperature. The material preferentially includes a thermally-activated adhesive, that is, an adhesive that becomes tacky or sticky at or about the temperature at which the material becomes deformable. The heel molder receives the upper assembly, forms the same at the heel region while the material is above the threshold temperature, cools the material whereby the thermally-activated material—and the upper itself and liner—takes a permanent preformed set as a laminate for later operations. According to the present teaching, the thermally-activated material or counter, the upper and the lining of the upper typically form, when cooled, a laminate that retains its geometry for subsequent operations thereon.

8 Claims, 2 Drawing Sheets

HEEL MOLDER

Figure 1:
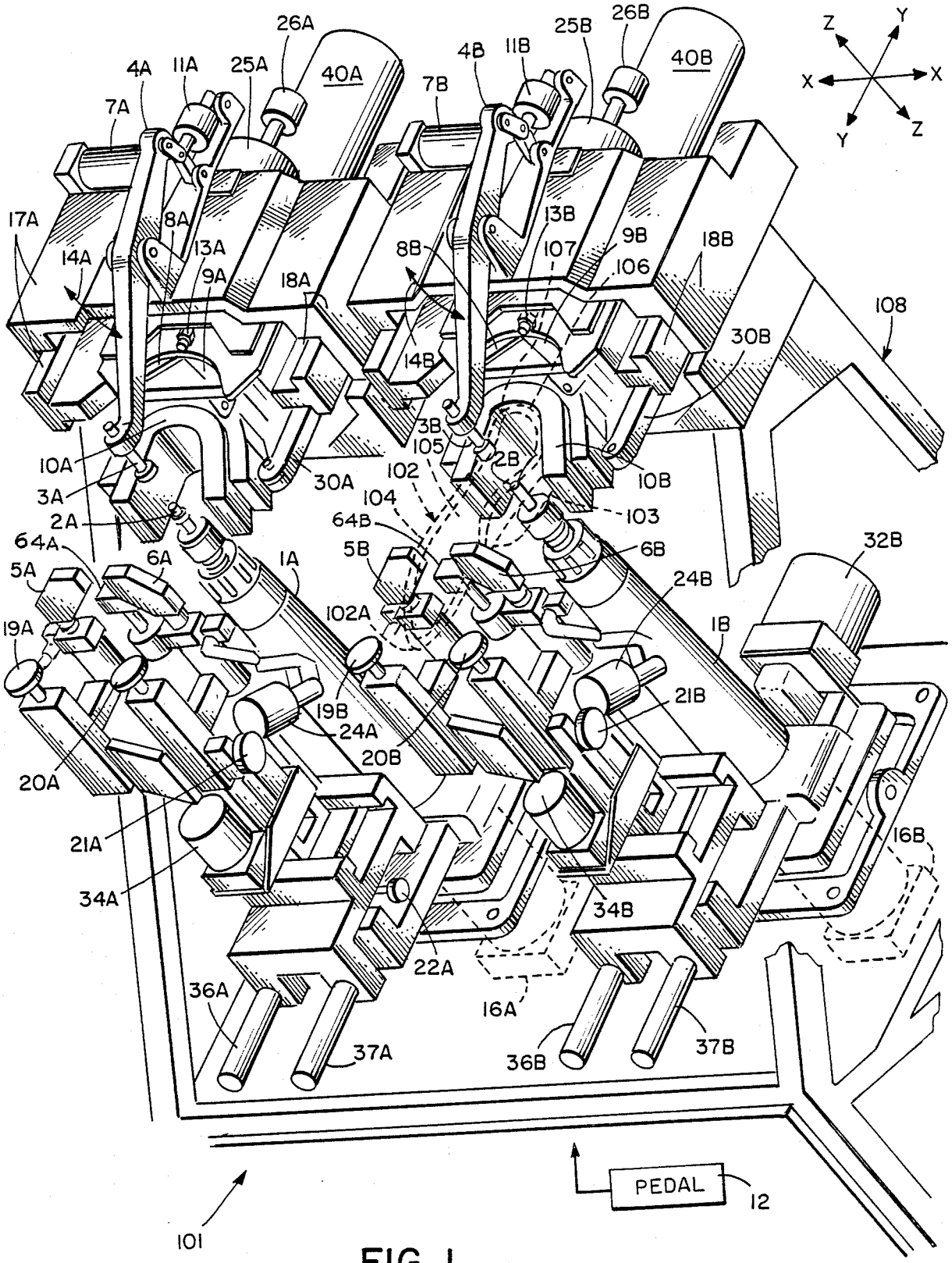

This is a continuation-in-part of a patent application Ser. No. 186,417, filed Apr. 26, 1988 (now abandoned).

The present invention relates to a machine to mold the heel region of a shoe or other footwear upper.

Attention is called to U.S. Pat. No. 4,660,242 (Vornberger et al.) wherein there is disclosed an activator for heating and shaping the heel portion of a shoe upper (in this specification reference is made mostly to shoes, but the invention has relevance to footwear more broadly), the heel portion being heated and then stretched about a mold having a back portion approximately the ultimate shape of the shoe heel portion. The heated upper is then typically transferred to a heel molder flanger (HMF) of the type shown in U.S. Pat. No. 4,709,433 (Walega) and the further prior art cited (e.g., the bulletins of record). The heel molder flanger has a cooled mold to receive the heated upper whose back portion approximates the ultimate shape of the heel of the ultimate shoe. The word "approximates" is emphasized here, because the mold of the HMF is used for many, many different shoe styles and shapes, as well as left shoes and right shoes; hence, in most cases it is only near to the shape of the last which corresponds to the ultimate shape of the finally-fabricated shoe. The industry long has sought a way to form the heel portion of the shoe upper to the exact shape of the ultimate shoe.

Accordingly, it is an objective of the present invention to provide a heel molder that forms the heel portion of the shoe upper to the exact contour of the ultimately fabricated shoe for varying styles, sizes, as well as left shoes and right shoes.

The foregoing is a non-trivial problem, but according to the present teaching another benefit of the invention results: the upper is formed about the last on which the shoe will be lasted and finally fabricated. Hence, according to modern fabricating techniques, the product, the shoe, will be less costly to fabricate—again a non-trivial matter.

A further objective of the invention is, then, to provide a machine that reduces the cost of shoe fabrication.

The heel portion of a shoe upper typically includes a thermally-activated material, that is, a material that becomes flexible when heated above some threshold temperature and becomes relatively—and sharply—rigid below that temperature. It is rigid at and below room temperatures. The present machine is intended to receive the shoe upper when the material is flexible, to form the flexible heel portion to the ultimate shape thereof, and to maintain that shape while the thermally-activated material is changing from flexible to rigid in character.

A still further objective, then, is to provide a machine that receives the heated shoe upper draped aboout a last and forms the heel and shank region of the shoe upper about the heel region of the last to the exact form that heel and shank region will take, while withdrawing enough heat from the thermally-activated material for the latter to become rigid and therefore fixed in shape.

Contouring of the heel portion of the upper in all shoe styles and types is important—women's shoes in particular—but it must be recognized that such contouring encompasses shaping of more than the back of the shoe; it most particularly includes producing a substantially flat heel seat with a clearly-defined edge, that is, the border between the heel seat (which is in the flat heel plane, the X-Y plane herein) and generally the plane of the sides of the shoe upper (i.e., the Y-Z plane herein, approximately).

Another objective of the invention is to provide a machine that can fashion the heel portion of the shoe upper to a shape that exhibits a flat heel seat and a well-defined edge between that heel seat and the adjacent proximate sides of the upper.

These and still further objectives are addressed hereinafter.

The foregoing objectives are achieved, generally, in a heel molder (and method) to receive a footwear upper assembly that includes a last, a footwear upper draped about the last and an insole disposed on the last bottom, the heel molder being adapted to form the heel part of the upper about the heel part of the last, the heel part of the upper having a margin that extends downwardly from the insole, the heel part of the upper including a material which can be deformed and will take a preformed set as well as a thermally-activated adhesive at each major surface thereof, the heel molder including a mechanism to achieve mechanical attachment of the last to the machine; pincers positioned to grasp the upper at its toe or forepart region and operable to draw the upper in the toe direction of the footwear upper assembly to stretch the heel part of the upper—which has been heatef by an activator or the like (see the Vornberger et al '242 patent)—about the heel portion of the last; a pad adapted to apply pressure to form or shape the upper about the heel portion of the last and the shank portion thereof; wipers operable, while the pad is in clamping engagement of the footwear upper assembly, to wipe the upstanding margin of the upper onto the insole at the last bottom, whereby the heel portion of the upper, including the thermally-activated material and other upper parts to adhere to each other as laminate take a permanent preformed set; and a bedding mechanism that is operable to apply high bedding pressure between the wiped margin, the margin and lining disposed between the insole and the wipers, to overcome remnant or residual mechanical memory of the upper and other heel parts to achieve sharp moldng definition, i.e., a sharp edge between the side of the upper and the wiped margin thereof.

Figure 2:
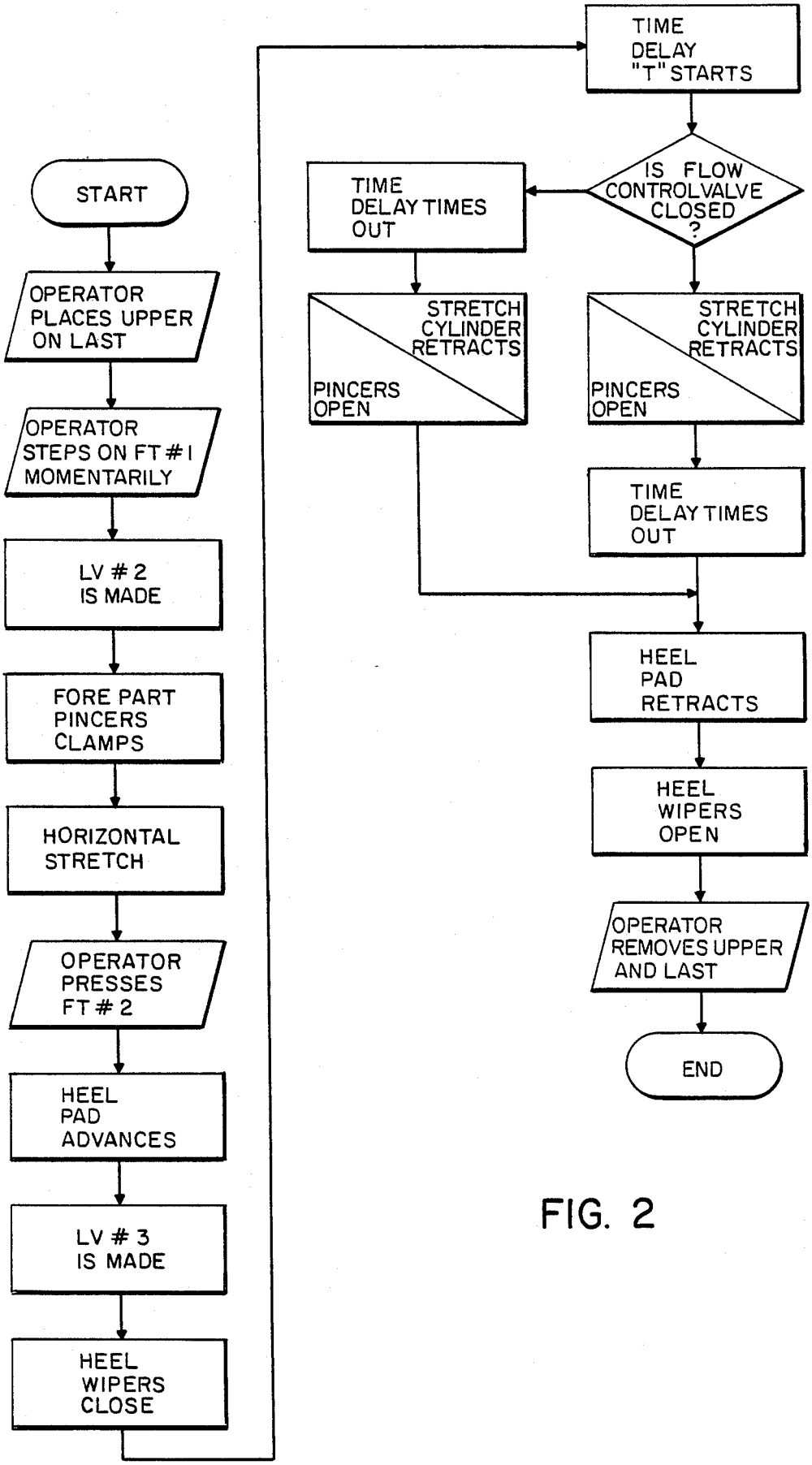

The invention is hereinafter discussed with reference to the accompanying drawing in which:

FIG. 1 is an isometric view of a machine, partly diagrammatic in form, that embodies the inventive concepts herein, some parts being in phanton and partly cutaway; and FIG. 2 is a sequence flow chart of the machine in FIG. 1.

Turning now to the drawing, there is shown at 101 a heel molder mechanism to receive a footwear upper assembly 102 that includes a last 103, a footwear upper 104 draped about the last 103 and an insole 105 disposed on the last bottom, the heel molder 101 being adapted to form the heel part 106 having a margin 107 that extends outwardly or upwardly from the insole 105. The heel part, as is common in the industry, includes a thermally-activated material that is deformable when heated above a threshold temperature and is relatively non-deformable below the threshold temperatures. The thermally-activated material is rigid (in the context of this disclosure) at room temperature; and it has a thermally-activated adhesive on each major surface thereof.

The operator is intended to stand in front of the machine 101 looking in the plus Y-direction. Directions extending toward the operator (i.e., minus Y-direction) will be designated as "forward" and directions extending away from the operator will be designated as "rearward." The front of the machine is closest to the operator and the back of the machine is furthermost from the operater. Furthermore, the plus-minus Y-direction movements are not horizontal, even though implicitly indicated to be such. They are rather at about forthy-five degrees to the horizontal from "forward" to "rearward", but their tilt is only for convenience. In this specification plus-minus Y-direction, that is, forward and rearward movements of machine parts, may be horizontal, but are usually at an angle to the horizontal. Another matter is addressed at this juncture.

As later noted herein, the machine 101 includes a spindle 1B(1A). (The heel molder machine 101 is a two-station machine; mechanisms on the left side thereof are essentially mirror images of—or identical to—mechanisms on the right side thereof. In this specification the letter A indicates a machine part at the left side of the machine 101 and the letter B indicates a machine part at the right side of the machine: the spindle 1B(1A).) The spindle 1B(1A) is similar to a spindle in the side and heel lasting machine of U.S. Pat. No. 4,553,281 (Vornberger) and its predecessor patents, which discuss holdown features of the spindle and a lock of the spindle which may be released during wiping to apply bedding pressure between wipers and the upper at the margin thereof. (See, also, U.S. Pat. No. 4,679,269, Becka et al. for a spindle that applies bedding, even high, pressure.) The Vornberger '281 patent and its predecessors include a mechanism which deposits an adhesive into the region between the margin and the insole. The present invention contemplates a structure wherein there is no such adhesive, but there may be co-activate adhesives. The remainder of the specification assumes a situation wherein the formation of the heel region of the upper is formed similarly to that like formation in the '433 (Walega) patent, but is formed about a last (which is typically a plastic material or the like and mostly heat insulating), which is shaped essentially, in the heel and shank region, to the shape of the ultimate shoe. The problem as discussed herein, is that of extracting enough heat energy from the deformed heel region of the upper 104 of the upper assembly 102 that the heel region will retain its deformation for subsequent operations (e.g., heel lasting) thereon. The recognition of this likelihood is a significant advance in this cost-conscious art.

The heel molder 101 includes the spindle 1B(1A) which includes a last pin 2B(2A), in FIG. 1 that is typically received by a recess in the last 103, as is well known. Also, typically, the machine 101 includes a holdown mechanism 3B(3A) which, as later discussed, serves to establish a wiping plane and a toe rest 64B(64A). The holddown mechanism 3B(3A), according to the present teaching, is pivoted by an air cylinder 7B (7A) from a standby position into a position slightly spaced above the insole 105 by swinging or rotating an arm 4B(4A)—see arrow 14B (14A)—from the standby position to a position slightly spaced above (plus Z-position) from the insole 105. Swinging or rotating the arm 4B(4A) from the standby position to a position slightly spaced from the insole reduces travel distance and hence achieves faster movement from position-to-position thereof. The swinging action is effected by a pivot air cylinder 7B(7A) through an appropriate mechanical linkage; an air cylinder 11B (11A) pivots the holdown toward the assembly 102.

As noted above, the holdown 3B(3A) presses the last 103 firmly onto the spindle 1B(A). At that point, pincers 5B(5A) and 6B(6A), which are positioned to grasp the upper 104, at its toe or forward region 102A and are operable to draw the upper 104 in the toe direction of the footwear upper assembly (i.e., minus Y-direction) to stretch the heel part of the upper 104 about the heel part 106 of the last 103, perform that function. At this juncture in shoe formation, a pad 10B(10A) moves forward and is closed about the heel and shank part of the footwear upper assembly, wipers 8B(8A) and 9B(9A) move forward and pivot closed to wipe the margin 107 onto the insole 105, whereby the thermally-activated material and other parts in the upper heel take the permanent preformed set, as a laminate, for later operations upon the footwear upper assembly 102.

According to the present teaching, the machine 101 is capable of applying high—very high—bedding force between the wiped margin 107 and the insole 105. That bedding force is adjustable between about 200 and 900 pounds. That bedding force is possible, in the machine 101, because the bedding force is achieved by the wipers 8B(8A) and 9B(9A), and because the wipers 8B(8A) and 9B(9A) are structured to mechanically transmit the bedding force directly to the frame 108 of the machine 101, as distinguished from earlier machines. According to this teaching forces between the wipers and the upper assembly 102, in the course of bedding, are transmitted mostly about one-for-one to the frame 108 through head slides 17B(17A) and 18B(18A), whereas in earlier machines that force was somewhat magnified by a lever arm multiplier: rod ways that could bend under the large bending forces. The rod ways have not been included in the machine 101 and the leverages now present have been greatly reduced so that the bedding forces and the reaction forces onto the frame 108 bear, about, a one-for-one relationship.

Bedding is achieved by an air cylinder 16B (16A) which applies a small plus-Z force to raise the upper assembly into contact with the holdown 3B(3A) and a much larger plus-Z force between about 250 pounds and 900 pounds to effect bedding. Typically the applied bedding force is about 400 pounds. The aim of the bedding pressure is to apply a high bedding force between the insole at the footwear upper assembly bottom and the wipers, with the margin sandwiched therebetween to overcome the remnant or residual mechanical memory of the upper and to deform the thermally-activated material in the heel of the upper to a new shape. A significant aspect of this invention is that of permitting sufficient time for heat to be withdrawn from the heel region of the upper; the time is contributed to by the dual-station aspects of the machine 101 that provides enough lapse time at each station to withdraw heat from the heel region of the upper, whereby the upper at the heel region takes an acceptable set.

To summarize somewhat what has been said, the heel region of the upper is heated to activate all parts thereof, including a thermally-activated material therein; it is introduced to the machine 101 as part of a footwear upper assembly. There then occurs a sequence of events, which somewhat overlaps each other (see FIG. 2). The pincers 5B(5A) and 6B(6A) under low pressure grasp the forward part of the upper and draw or stretch the upper about the heel portion of the last. When—or while—the upper is so drawn or stretched, the pad 10B(10A) is forced into contact and conformance with the heel region of the footwear upper assembly where it applies substantially uniform pressure to force the upper, with the thermally-activated material therein to take a shape corresponding to the heel portion of the last, while the pad is so engaged in forming the heel portion of the upper. (Typically, at this juncture, the stretching force exerted by the pincers is increased). At that time—and while the pad is in engagement of the heel region of the upper—the wipers wipe the upstanding margin over the insole at the heel portion and the shank portion of the footwear upper assembly. While these operations are efficient and of only a few seconds duration, the contact of the preheated upper with the last and other parts of the machine 101 causes the thermally-activated material and adhesive in the the heel of the upper—and, indeed the upper itself—to cool sufficiently to retain the shape induced by conformity to the shape of the last.

A few more matters addressed generally earlier and in FIG. 2 are now taken up. Inputs "FT" in FIG. 2 designate inputs of the pedal labeled 12 in FIG. 1. Knobs 19B (19A), 20B(20A), 21B(20A) and 22B(22A) are connected to—or are part of—threaded rods and serve to adjust pincers height (19B(19A)–20B(20A)), fine adjustment of pincers width (21B(21A)) and offset the toe support 64B(64A) for left and right shoes (22A). Movement of the pincers in the minus Y-direction to achieve stretching or drawing of the heel part about the heel portion of the last is achieved by an air cylinder 24B(24A) through appropriate mechanical pivotal linkages; it should be noted that FT#1 in FIG. 2 results in low pressure initial stretching and FT#2 results in high-pressure ultimate stretching, as above indicated. A threaded wiper adjustment knob 13B (13A) adjusts fore-aft wiper positioning; air cylinders 25B(25A), through appropriate linkages, pivot the wipers in wiping action, the stroke of wiper pivotal action in wiping being controlled by a threaded knob 26B(26A). Air cylinders 40B(40A) drive the pads 10B(10A) through linkages 30B(30A) to perform the functions above described. A sizing drive motor 32B (the other motor is not shown) adjusts the machine parts along sides 36B(36A) and 37B(37A) to accommodate various sizes; it, 32B, is a dc motor. Another dc motor 34B(34A) adjusts of varying heel height of footwear, again through appropriate linkages. The pincers 5B(5A) and 6B(6A) are part of the pincers and toe support assembly, which further includes the toe support 64B(64A), structured to move as a unit toward and away from the spindle 1B(1A) to adjust for size of the footwear upper assembly 102, movement as a unit serving to maintain the bottom of the footwear upper assembly in the plane of wiping.

A few further comments are in order. The thermally-activated counter material in the heel part of the upper has a thermall-activated adhesive on each major surface thereof; the adhesive becomes tacky when heated above a threshold temperature (about 240° F. to 280° F.; and this is known) and becomes adherent below that threshold temperature (it is adherent at room temperature). The heel of the upper, the thermally activated material and the lining of the upper are thus formed, when cooled, into a laminate which retains its formed contour (i.e., by the machine 101) at room temperature. The inventors have found that the laminate can be provided in and by the machine 101.

Further modifications of the invention will occur to persons skilled in the art and all such modifications are deemed to be within the scope of the invention as defined by the appended claims.

What is claimed is:

1. A method of heel molding of a footwear upper assembly that includes a last, a footwear upper draped about the last and an insole disposed on the last bottom, to form the heel part of the upper having a margin that extends outwardly from the insole, the heel part of the upper including a thermally-activated material that is deformable when heated above a threshold temperature and relatively non-deformable below the threshold temperature, said thermally-activated material having a thermally-activated adhesive on each major surface thereof, said method comprising the sequential and somewhat overlapping steps:

receiving the upper assembly with a preheated upper thereon by a spindle;

pressing the last with the preheated upper thereon firmly onto the spindle;

grasping the upper at its toe or forward region and drawing the preheated upper on the toe direction of the footwear upper assembly to stretch the heel part of the heated upper about the heel portion of the last;

while the heel part of the upper is thus stretched about the heel portion of the last, applying a pad adapted to exert a substantially uniform pressure to form or shape the upper about the heel portion of the last and the shank portion of the last;

wiping the heel part of the heated upper while the pad is in engagement with clamping the heel part of the upper against the last, to press the margin onto the insole whereby the thermally-activated material and heel part of the upper and other parts of the heel region of the preheated upper are forced into intimate contact with last, pad and wiping mechanism to cause the thermally-activated material and other upper parts to adhere to each other forming a laminated structure and to cool sufficiently for said laminated structure to take a permanent preformed set to a shape induced by conformity to the last; and applying bedding pressure operable to apply high bedding force between the wiped margin and the wipers and sufficient to overcome the inherent mechanical memory of the upper to achieve sharp molding definition, i.e., a sharp edge between the side of the upper and the wiped margin thereof.

2. A method of molding a footwear upper assembly that includes a last, a footwear upper draped about the last and an insole disposed on the last bottom, to form the heel part of the upper having a margin that extends outwardly from the insole, the heel part of the upper including a thermally-activated material that is deformable when heated about a threshold temperature and relatively non-deformable below the threshold temperature, said method comprising the sequential and somewhat overlapping steps:

receiving the upper assembly with a preheated upper thereon by a spindle;

pressing the last with the preheated upper thereon firmly onto the spindle;

grasping the upper at its toe or forward region and drawing the preheated upper in the toe direction of the footwear upper assembly to stretch the heel part of the heated upper about the heel portion of the last;

while the heel part of the upper is thus stretched about the heel portion of the last, applying a pad adapted to exert a substantially uniform pressure to form or shape the upper about the heel portion of the last;

wiping the heel part of the heated upper while the pad is in engagement and clamping the heel part of the upper against the last, to press the margin onto the insole whereby the thermally-activated material and heel part of the upper and other parts of the heel region of the preheated upper are forced into intimate contact with the last, pad and wiping mechanism to cause the thermally-activated material and other upper parts to cool sufficiently for said heel part of the upper to take a permanent preformed set to a shape induced by conformity to the last for later operations upon the footwear upper assembly; and applying bedding pressure operable to apply high bedding force between the wiped margin and the wipers and sufficient to overcome the inherent mechanical memory of the upper to achieve sharp molding definition, i.e., a sharp edge between the side of the upper and the wiped margin thereof.

3. A method according to claim 1 or claim 2 in which said high bedding force is between about 250 pounds and 900 pounds.

4. A method according to claim 1 or claim 2 in which said high bedding force is about 400 pounds.

5. A method according to claim 1 or claim 2 that includes adjusting the fore-aft wiping position during the wiping of the heel part.

6. A method according to claim 1 or claim 2 that includes adjusting the height of said grasping to accommodate different footwear upper assembly shapes.

7. A method according to claim 6 in which said grasping is achieved by pincers and which includes adjusting the pincers' width to accommodate said different footwear upper assembly shapes.

8. A method according to claim 1 or claim 2 in which said drawing is achieved by an initial low-level drawing force and an ultimate high-level drawing force.

* * * * *